United States Patent [19]

Meyer

[11] Patent Number: 4,799,976

[45] Date of Patent: Jan. 24, 1989

[54] PROCESS FOR THE HEAT TREATMENT OF AL ALLOYS CONTAINING LI WITH A VIEW TO PRESERVING THEIR SURFACE HEALTH

[75] Inventor: Philippe Meyer, Voiron, France

[73] Assignee: Cegedur Societe de Transformation de l'Aluminum Pechiney, Paris, France

[21] Appl. No.: 165,008

[22] Filed: Mar. 7, 1988

[30] Foreign Application Priority Data

Mar. 9, 1987 [FR] France ..... 87 03581

[51] Int. Cl.[4] ..... C21D 1/74

[52] U.S. Cl. ..... 148/20.3

[58] Field of Search ..... 148/20.3

[56] References Cited

U.S. PATENT DOCUMENTS 3,084,080 4/1963 Hunter et al. ..... 148/20.3

4,534,807 8/1985 Field et al. ..... 148/20.3

*Primary Examiner*—L. Dewayne Rutledge

*Assistant Examiner*—David Schumaker

*Attorney, Agent, or Firm*—Dennison, Meserole, Pollack & Scheiner

[57] ABSTRACT

The invention relates to a process for improving the surface condition of Li-containing Al alloy products. According to the process, heating at a temperature exceeding 300° C. takes place in an atmosphere containing, in volume percent, 5 to 98% $CO_2$, $2 \leqq$ dry air $\leqq 95\%$ and the remainder water. The process prevents the appearance of surface pitting and reduces the depth of the Li-depleted surface zone.

3 Claims, 2 Drawing Sheets

FIG. 1A
PRIOR ART
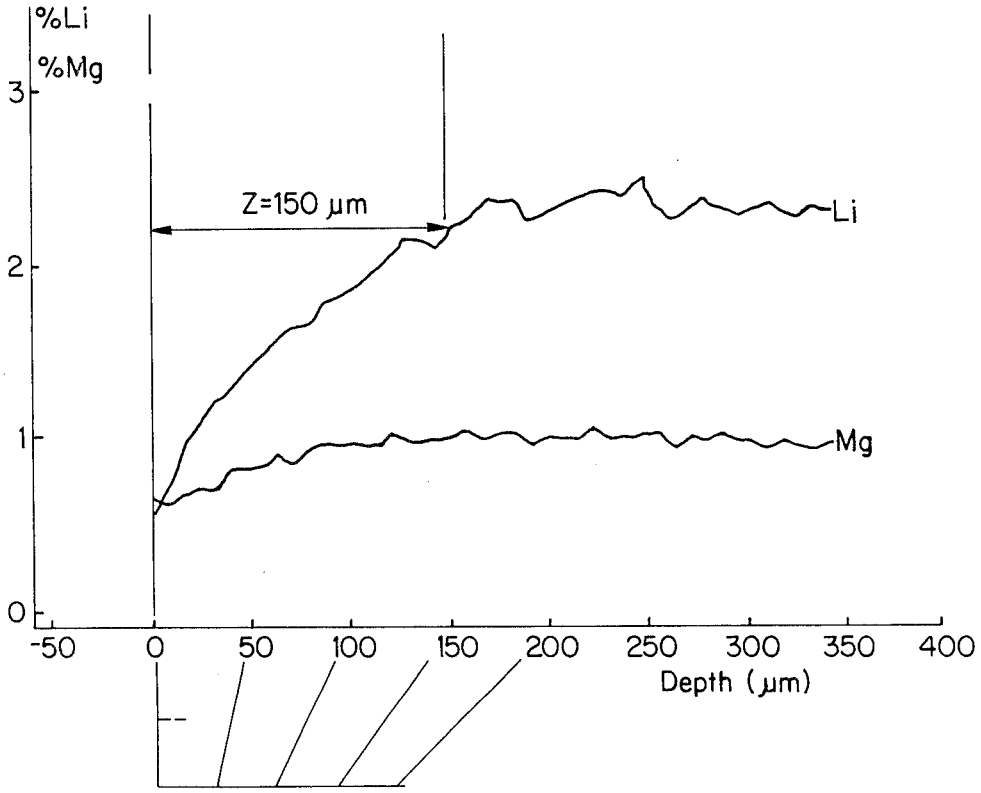
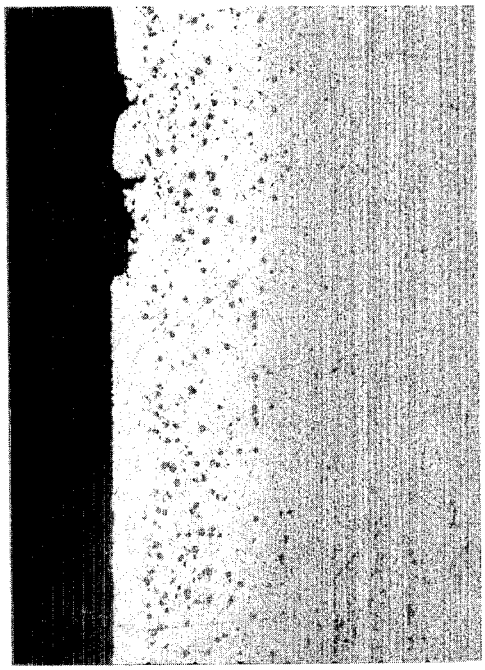
FIG. 1B
PRIOR ART

FIG. 2A
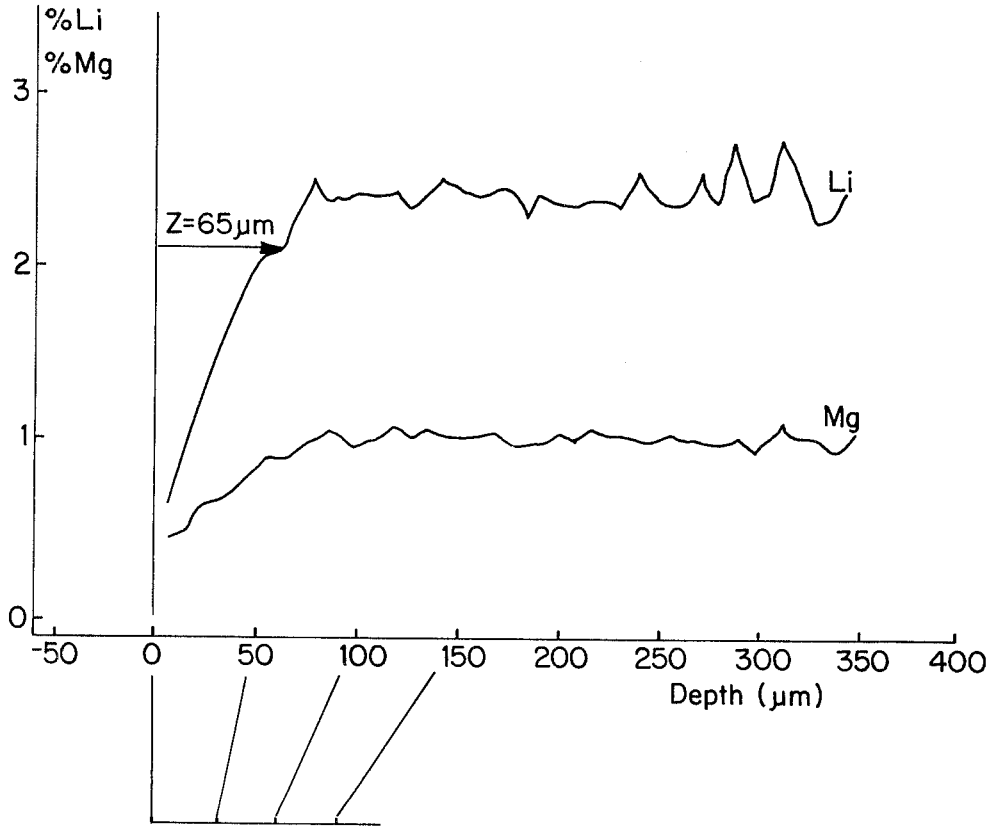
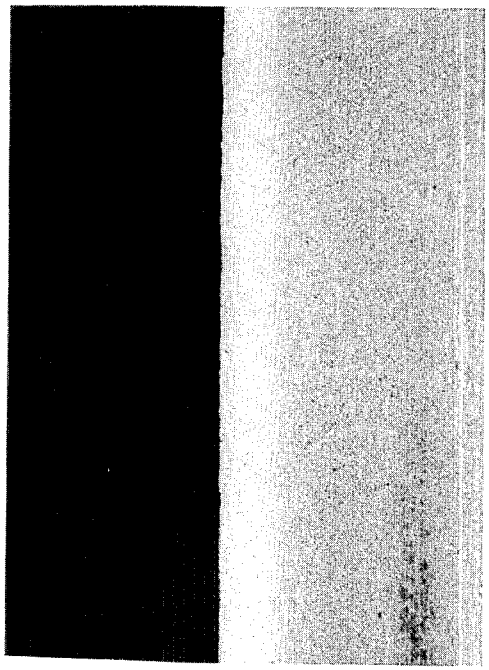
FIG. 2B

PROCESS FOR THE HEAT TREATMENT OF AL ALLOYS CONTAINING LI WITH A VIEW TO PRESERVING THEIR SURFACE HEALTH

The presently developed Al-Li-X alloys have attractive compromises with respect to their properties, so that they can be used as replacements for conventional alloys of series 2000 and 7000 used in aeronautics and with density gains of approximately 8 to 12% compared with the latter (cf. particularly P. Meyer, B. Dubost: "Production of aluminium-lithium alloys with high specific properties": Proceedings of the third Al-Li Conference: Oxford 1985—The Institute of Metals or G. Le Roy: "Aluminium-lithium alloys": Materiaux & Techniques No. 5-6, 1986—special issue).

However, the transformation of Al-Li-X alloys gives rise to difficulties not normally encountered with aluminium alloys. In particular, during high temperature heat treatments in industrial air furnaces, alloys containing lithium tend to undergo a large amount of pitting. This is often associated with the appearance of a layer of porosities located in the lithium-depleted zone and particularly at its inner limit. This depleted zone, well known in connection with aluminium-lithium alloys, is not in itself a handicap to the production of aluminium-lithium alloy intermediates, as it results from a general, uniform oxidation of the surface. However, porosities and particularly open pits appearing during high temperature treatments can lead to the rejection of industrially produced products.

It is known from EP-A-123453 that a moist $CO_2$ atmosphere able to contain up to 1% at the most of oxygen and nitrogen can ensure that Li-containing Al alloys are protected against high temperature oxidation, said limitation being justified by the fact that nitrogen is very noxious (cf. FIG. 1) and therefore tests were carried out in synthetic atmospheres of $O_2$+argon not containing nitrogen. However, this teaching is contrary to the object of the present invention.

The Applicant has attempted to solve the problem by modifying the composition (reduction of the lithium content or addition of beryllium), but this did not lead to satisfaction and surface pitting was just as great.

An effective solution was provided by treatment in a salt bath. However, this treatment requires an infrastructure not available in all the plants of producers and users.

The Applicant has solved this problem by controlling the atmosphere of the air furnace used for the heat treatment. The process according to the invention consists of performing the high temperature heat treatments (particularly those having a temperature exceeding 300° C.), such as homogenization and/or solutioning in an atmosphere containing (% by volume) 5 to 98% $CO_2$, $2 \leqq$ dry air $\leqq 95\%$ and the remainder $H_2O$. The preferred limits are 5 to 95% $CO_2$, $5 \leqq$(dry)air$\leqq 95\%$ and the remainder $H_2O$.

The $CO_2$ content can be reduced between 10 and 60% (and preferably between 12 and 50%), with dry air between 40 and 90% (preferably 50 to 88%) and the remainder water. Below 5% $CO_2$, it has been found that effective surface protection is not obtained.

Beyond 98 or 95% $CO_2$ there are problems in connection with the industrial performance in conventional air furnaces. It is then necessary to have furnaces with an adequate sealing and/or to carry out maximum purges of the air which has penetrated either on charging, or on discharging.

The upper limits of 50 or 60% $CO_2$ are justified for economic reasons. The lower limits of 10 and 12% are fixed to ensure effective protection, the latter being a function of the effective composition of the treated alloy.

This treatment applies to the solid state, even between liquidus and solidus. This process makes it possible on the one hand to eliminate the pitting of intermediates and on the other to eliminate the layer of porosities normally present in the lithium-depleted zone. Moreover, it reduces the depth of this lithium-depleted zone. The reason for the latter has not been explained as yet, but it is known that alloys containing lithium generally undergo the following oxidation phases in air:

1. Oxidation with the formation of in particular $Li_2O$,
2. Reaction of the oxide with the moisture of the air to form LiOH and
3. Reaction of the hydroxide LiOH with the carbon dioxide gas naturally present in the air to form $Li_2CO_3$, the end product of the reaction (cf. in this connection Fridlyander: "Oxydation of an Al-Mg-Li system with Be additive" Alyum Splavy, 1968, 5).

The atmospheres according to the invention containing $CO_2$ and $H_2O$ should therefore speed up the reaction process, which is the opposite to what was observed during the tests performed.

The process according to the invention is applicable to the standard atmospheres of air furnaces, without any particular limitation linked e.g. with the dew point or the presence of drying additives of the ammonium difluoride or sodium fluoborate type.

The invention will be better understood with the aid of the following examples illustrated by FIGS. 1A and 1B, illustrating a heat treatment according to the prior art, and FIGS. 2A and 2B, illustrating a heat treatment according to the invention.

FIG. 1A shows a profile of the Li and Mg contents as a function of the depth, perpendicular to the surface of the product, following treatment in an ordinary air furnace with the addition of ammonium difluoride (case B, example 1). The depth of the Li-depleted zone (z) is 150 μm (Li concentration=90% of the Li concentration in the core of the product).

FIG. 1B is a macrosection of the surface zone of the product in a short transverse-longitudinal plane following chromic etching and with a×200 magnification.

FIGS. 2A and 2B show the same elements for a treatment under $CO_2$ according to case D of example 1. The depth of the Li-depleted zone z is then 65 μm.

EXAMPLE 1

An alloy of type 8090: 2.55% Li-1.3% Cu-1.0% Mg-0.12% Zr-0.06% Fe-0.05% Si is cast into dia. 200 mm billets, homogenized for 24 hours at 535° C., the crust is removed, it is reheated in the induction furnace at 430° C. and hot extruded at this temperature into a flat bar of section 110×4 mm². This flat bar is then dissolved in an air furnace using the following treatment conditions:

placing in hot furnace,
dew point: 25° C.+3° C.
maintained at 533° C. for one hour.

Part is treated in an air furnace without any particular control of the atmosphere (case A: outside the invention). Another part of the flat bar is treated in an air furnace with the addition of ammonium difluoride (case B: outside the invention) at a rate of 7 g/m$^3$ (introduced into the furnace at the start of treatment). Another part is treated in the air furnace with 15% by volume $CO_2$ (case C: according to the invention). A final part of the flat bar is solutioned with the addition of ammonium difluoride at a rate of 7 g/m$^3$ introduced into the furnace at the start of the treatment and with 15% by volume of $CO_2$ (case D: according to the invention).

The results concerning the structure of the metal after dissolving and cooling in air are summarized in the following Table (micrographic examination).

| TREATMENT TYPE | SURFACE | POROSITIES |
|---|---|---|
| A: Outside invention | A few local pits at the ends of the flat bar. | Porosity layer present at the limit of the lithium-depleted zone. |
| B: Outside the invention (cf. FIG. 1) | Numerous pits over the entire surface | Large porosity layer in the Li-depleted zone. |
| C: According to the invention | No visible pit | Total absence of porosities. |
| D: According to the invention (cf. FIG. 2) | " | Total absence of porosities. |

It should also be noted from comparing FIGS. 1A, 1B, 2A and 2B that the treatment according to the invention reduces the lithium-depleted zone.

EXAMPLE 2

An alloy with a composition by weight as follows: 2.5% Li-3.0% Cu-0.3% Mg-0.12% Zr-0.04% Fe-0.03% Si is cast into dia. 450 mm billets homogenized for 12 hours at 515° C., raised by 25° C./h to 538° C. then kept for 12 hours at 538° C., reheated to 430° C., hot extruded into a dia. 180 mm bar, which is cut into parts and hot extruded at the same temperature into an H-section with an extrusion ratio of 27. This section is then discharged in various lengths undergoing different solutioning operations in the air furnace under the following conditions:

Case E (outside the invention): placed in furnace at 430° C. and raised in 20 minutes to 538° C. and then kept there for 1 hour; dew point 5° C.+3° C.; presence of ammonium difluoride (introduced at a rate of 7 g/m$^3$ at the start of treatment).

Case F (outside the invention): placed in furnace at 538° C. and kept there for one hour; dew point 5° C.+3° C.; presence of ammonium difluoride (introduced at a rate of 7 g/m$^3$ at the start of treatment).

Case G (outside the invention) placed in the furnace at 538° C. and kept there for one hour, dew point 5° C.+3° C.

Case H (according to the invention) placed in the furnace at 538° C. and kept there for one hour; dew point 5° C.+3° C.; presence of 65% by volume carbon dioxide gas in the furnace.

In all cases, solutioning is followed by quenching in cold water. The samples taken at either end of the solutioned length are then examined under the optical microscope.

Results:

| TREATMENT TYPE | SURFACE | POROSITES |
|---|---|---|
| E: Outside invention | Presence of | Layer of porosities generally located at the limit of the Li-depleted zone. |
| F: Outside invention | numerous pits. | |
| G: Outside invention | | |
| H: According to the invention | No pits | No porosities |

EXAMPLE 3

An alloy of type 2091 with the following composition by weight: 2.1% Li-2.3% Cu-1.2% Mg-0.12% Zr-0.10% Fe-0.07% Si is cast into plates with a section of 800×300 mm$^2$, homogenized for twelve hours at 532° C., "scalped", hot rolled between 490° and 400° C. to 12 mm, this sheet then being discharged and undergoes the following dissolving operations:

Case I (outside invention) placed in furnace at 530° C. and kept there for two hours, dew point −20° C.+5° C.; $CO_2$: 2% by volume.

Case J (according to the invention): same treatment but with 8 vol % of $CO_2$.

There are a few local pits on the sheet in the case outside the invention, but they do not appear when the treatment is carried out according to the invention.

I claim:

1. Process for the heat treatment of Al alloys containing Li with a view to preserving their surface condition, comprising heating above 300° C. in an atmosphere containing, in % by volume 5 to 95% $CO_2$, $5 \leqq air \leqq 95\%$ and the remainder $H_2O$.

2. Process according to claim 1 wherein the $CO_2$ content is between 10 and 60%, the air content between 40 and 90% and the remainder $H_2O$.

3. Process according to claim 1, wherein the $CO_2$ content is between 12 and 50%, the air content between 50 and 88% and the remainder $H_2O$.

* * * * *